United States Patent [19]

de Munck

[11] 3,968,611

[45] July 13, 1976

[54] DILATION JOINT STRIP

[75] Inventor: Eduard Herman Louis de Munck, The Hague, Netherlands

[73] Assignee: International B. F. Goodrich-Europe B.V., The Hague, Netherlands

[22] Filed: Sept. 9, 1974

[21] Appl. No.: 504,176

[30] Foreign Application Priority Data

Sept. 20, 1973 Netherlands ..... 7312973

[52] U.S. Cl. ..... 52/396; 404/56; 404/64

[51] Int. Cl.[2] ..... E04B 1/62; E04F 15/14

[58] Field of Search ..... 404/47, 68, 65, 67, 404/66, 56, 64; 52/403, 573, 393, 396, 470, 471; 49/486, 479, 489, 498

[56] References Cited

UNITED STATES PATENTS

| | | | |
|---|---|---|---|
| 2,228,052 | 1/1941 | Gardner | 404/64 X |
| 2,368,650 | 2/1945 | Fischer | 404/65 |
| 2,374,186 | 4/1945 | Fischer | 404/47 |
| 2,400,493 | 5/1946 | Fischer | 404/56 X |

FOREIGN PATENTS OR APPLICATIONS

| | | | |
|---|---|---|---|
| 702,238 | 1/1965 | Canada | 404/65 |

OTHER PUBLICATIONS

Engineering News–Record, Mar. 18, 1948, p. 183.

*Primary Examiner*—Ernest R. Purser
*Attorney, Agent, or Firm*—Karl W. Flocks

[57] ABSTRACT

A dilation joint strip of rubber, synthetic rubber or other synthetic material having a substantially flat middle portion and side wings, said side wings being provided with anchorage means for anchoring said wings in concrete, the substantially flat middle portion being provided at either side with a strip of elastic cellular material extending in the longitudinal direction of said substantially flat middle portion.

3 Claims, 4 Drawing Figures

DILATION JOINT STRIP

Figure 1:
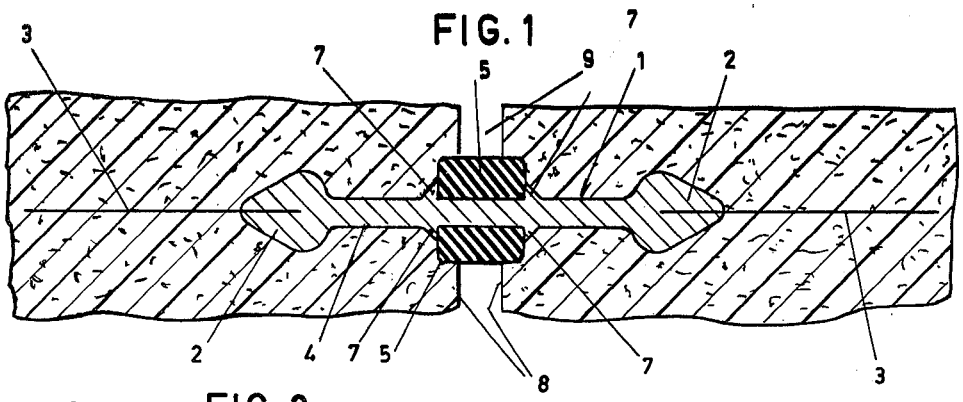

This invention relates to a dilation joint strip of rubber or some other elastically deformable material.

Such joint strips are generally known. These known joint strips usually comprise a tubular central portion with two striplike side wings of which the portions situated in the dilation joint strip are everywhere of the same thickness. Said known joint strips present the drawback that the tubular central portion has a thickness amounting to nearly twice the thickness of the side wings so that consequently said tubular portion is too rigid and the movements of the dilation joint strip have to be produced mainly by that tubular central portion of the side wings which is not embedded in the concrete of the building structure.

The invention aims at obviating said drawback which is accomplished with the dilation strip according to the invention in that at least a portion of the joint strip lying intermediate the longitudinal edges thereof and at a distance therefrom is mainly flat, and in which the central portion is provided on both sides thereof with a longitudinally extending strip of elastic cellular material, such as sponge or foam rubber, synthetic foam and viscose sponge. These strips consisting of elastic cellular material are easily deformable and do not offer almost any resistance to deformation so that they do not impede the movements of the joint strip portion located in the dilation joint.

According to the invention the strips consisting of elastic cellular material may be adhesively fixed to the joint strip. The adhesion of said strips of foamed material to the central portion of the joint strip need not be strong and consequently these strips can be pasted to the joint strip for example with the aid of a double-sided adhesive tape. Hence the joint strip can be manufactured in the same way as the known joint strips while omitting the tubular central portion, whereupon the strips of foamed material are pasted on both sides of the central portion of the joint strip. In case the strips consist of sponge or foam rubber they may also be fixed to the central portion of the joint strip by vulcanization.

According to the invention the strips consisting of elastic cellular material may have a substantially rectangular cross-section. In this way one obtains the advantage that the shuttering for casting the concrete can be placed while fitting well in a simple manner to said strips. Also the width of the flat upper surface of said strip is so ample that any inaccuracies resulting from the provision of the shuttering cannot have an unfavourable influence.

According to the invention the strips consisting of elastic cellular material may have at least one upright portion serving as a stop for a shuttering. Said upright portion may be integral with the strip or it may be pasted on said strip. However, the strips consisting of elastic cellular material preferably may have an U-shaped cross-section. Said U-shaped strips may be integral or may be composed of individual pieces respectively in which case one may use different materials.

A preferred embodiment of the dilation joint strip according to the invention is characterized in that it is provided at both sides with two ribs extending in its longitudinal direction and between which the strips of elastic cellular material are arranged. According to the invention these ribs preferably have the shape of a substantially right angled triangle, a leg of each of these ribs, which is perpendicular to the corresponding face of the joint strip, abutting against a side face of the strips consisting of elastic cellular material. This facilitates the provision of these strips in the correct place, since this place where said strips have to be arranged is defined by said ribs. Moreover, these ribs present the advantage that no sharp concrete edges are formed and damage to the dilation strip is prevented.

The invention will be further explained below with reference to the drawings showing by way of example an embodiment of a dilation strip arranged in a building structure.

Figure 2:
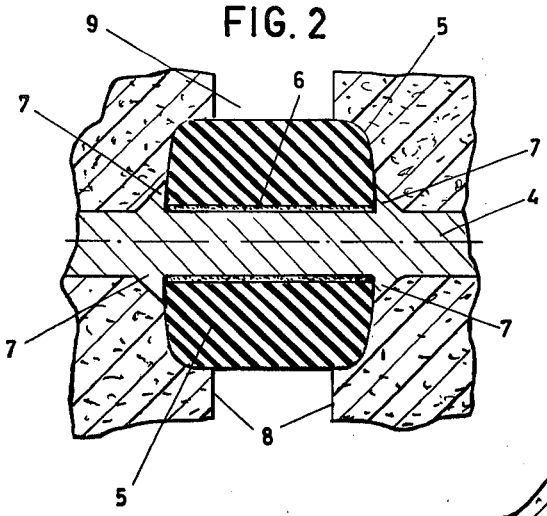
Figure 3:
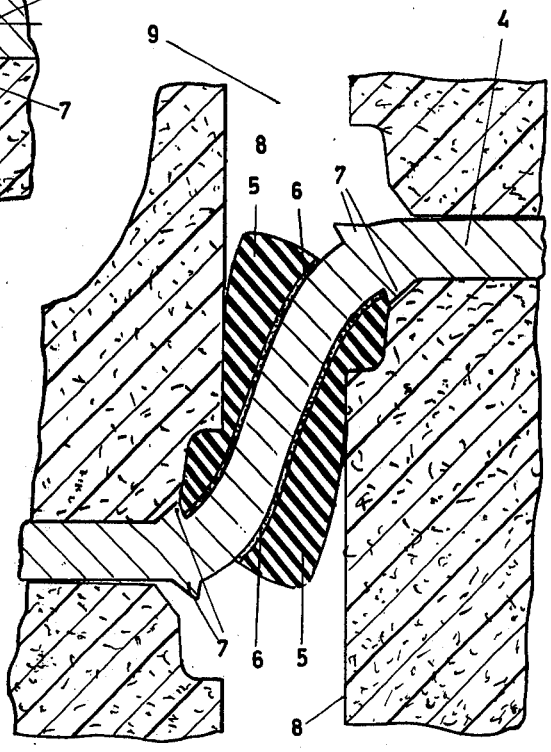
Figure 4:
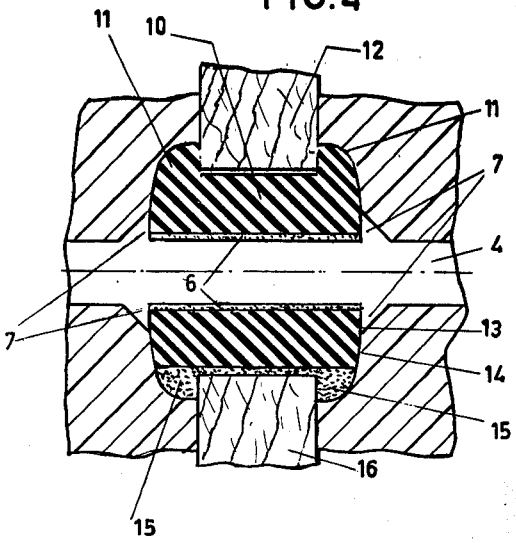

These drawings show in:

FIG. 1 a section through the dilation joint strip;

FIG. 2 on an enlarged scale the central portion of said joint strip in non-deformed condition;

FIG. 3 on an enlarged scale the central portion of said joint strip in deformed condition, and in FIG. 4 on an enlarged scale two other embodiments of the central portion of the dilation joint strip.

The dilation joint strip 1 shown in the drawings comprises a strip of rubber, synthetic rubber or some other synthetic material, the longitudinal edge portions 2 of which are thicker and present in cross-section the shape of a drop or pear. From each longitudinal edge portion there projects a metal strip 3, an edge portion of which is embedded in the corresponding thicker portion 2 of the joint strip and which in the event of the joint strip consisting of rubber is secured by vulcanization in said thicker longitudinal edge portion.

A substantially flat intermediate portion 4 of the dilation joint strip 1 situated between the longitudinal edge portions 2 has in cross-section mainly the shape of a rectangle.

On either side of the dilation joint strip 1 there is arranged a strip 5 of elastic cellular material, for example foamed synthetic material or sponge rubber, said strips 5 extending on either side of the longitudinal centre line of the dilation joint strip 1. Said strips 5 present in cross-section mainly the shape of a rectangle. These strips are glued or vulcanized to portion 4 of the joint strip. Glueing may be effected with the aid of an adhesive layer or a double-sided sealing tape.

On either side of each strip 5 there is a rib 7 having the shape of a right angled triangle one leg of which is perpendicular to portion 4 of the joint strip. The sides of the ribs 7 extending obliquely relative to the sides of the joint strip portion are facing each other on either side of the joint strip. Said ribs 7 prevent sharp edges of the concrete structure in which the dilation joint strip is arranged from damaging said joint strip.

FIG. 3 shows the joint strip 1 in deformed condition. As a apparent from said Figure the entire portion of the joint strip 1 comprising strips 5 of the elastic cellular material may deform itself, said strips 5 abutting partly against the walls 8 delimiting the dilation joint 9. The portion of the joint strip 1 clad with said strips can uniformly expand and shrink since it has everywhere the same section. As these strips 5 can offer only little resistance they impede said expanding and shrinking only to a negligible extent.

FIG. 4 shows part of a dilation joint strip on the upper surface of which by means of an adhesive layer 6 an U-shaped strip 10 of elastic cellular material is glued. Between the upright legs 11 of said strip there is situated the lower end of a shuttering 12 which after pouring and hardening of the concrete is removed. The upright legs 11 can also be formed by individual portions which are glued to a strip 5 of mainly rectangular cross-section and consisting of elastic cellular material, as shown in FIG. 2, so that one is free in the selection of the material used for said upright portions. Also, instead of two upright portions only one upright portion may be used which serves as a stop for the lower end of the shuttering.

To the bottom surface of the dilation joint strip shown in FIG. 4 there is glued with the aid of a layer 6 of adhesive a strip 13 consisting of elastic cellular material and presenting in cross-section a mainly rectangular shape. On the side of the rectangle facing the one which is secured to portion 4 of the joint strip there is glued an U-shaped strip 14. This strip may, if necessary, consist of some other elastic material than the one used for strip 13. The end of a shuttering 16 is located between the upright legs 15 of strip 14.

It is obvious that the invention is not restricted to the embodiment described in the proceding text with reference to the drawings, but that it may be modified in many ways without departing from the scope of the invention. this holds in particular as regards the longitudinal edge portions 2, 3 of the joint strip the embodiment per se of which does not form part of the invention.

I claim:

1. A dilation joint strip for sections of masonry defining a gap between the sections of masonry joined therewith and in which said sections of masonry have opposed recesses facing each other, said joint strip having a substantially flat intermediate portion and anchoring side wings integral therewith consisting of a solid material such as rubber, artificial rubber and other elastic deformable synthetic material, said anchoring wings being combined with further anchorage means for reliably anchoring said anchoring wings in the sections of masonry, said joint strip being provided at either side with a central strip of elastic cellular material extending in the longitudinal direction of said intermediate portion with opposite ends thereof in said opposed recesses and having a width greater than the width of the gap between said sections of masonry, said central strip covering said flat intermediate portion and also the end portions of the anchoring wings so that when said joint strip is in use, both end portions of said central strip are embedded in said recesses in said sections of masonry, said joint strip also including means for maintaining said central strips in place thereon.

2. A dilation joint strip for sections of masonry defining a gap between the sections of masonry joined therewith and in which said sections of masonry have opposed recesses facing each other, said joint strip having a substantially flat intermediate portion and anchoring side wings integral therewith consisting of a solid material such as rubber, artificial rubber and other elastic deformable synthetic material, said anchoring wings being combined with further metal strip anchorage means for reliably anchoring wings in the sections of masonry, said joint strip being provided at either side with a central strip of elastic cellular material extending in the longitudinal direction of said intermediate portion with opposite ends thereof extending in said opposed recesses and having a width greater than the width of the gap between said sections of masonry, said central strip covering said flat intermediate portion and also the end portions of the anchoring wings so that when said joint strip is in use, both end portions of said central strip are embedded in said recesses in said sections of masonry, said joint strip also including means for maintaining said central strips in place thereon, said intermediate portion further including at either side thereof two ribs spaced apart from each other at a distance and extending in the longitudinal direction of said intermediate portion, the central strips of elastic cellular material being secured between said ribs.

3. A dilation joint strip according to claim 2, characterized in that the ribs are in the shape of a substantially right-angled triangle with a leg of each of said ribs, perpendicular to the corresponding face of the joint strip, abutting against said corresponding side face of the central strips consisting of elastic cellular material.

* * * * *